US011596571B2

(12) United States Patent
Milandri et al.

(10) Patent No.: US 11,596,571 B2
(45) Date of Patent: Mar. 7, 2023

(54) CONTINUOUS PASSIVE MOTION APPARATUS

(71) Applicant: MEDEV INNOVATIONS (PTY) LTD, Greenpoint (ZA)

(72) Inventors: Giovanni Sergio Milandri, Greenpoint (ZA); Geoffrey Darren Foat, Greenpoint (ZA)

(73) Assignee: MEDEV INNOVTIONS (PTY) LTD., Greenpoint (ZA)

( * ) Notice: Subject to any disclaimer, the term of this patent is extended or adjusted under 35 U.S.C. 154(b) by 429 days.

(21) Appl. No.: 16/771,259

(22) PCT Filed: Dec. 12, 2018

(86) PCT No.: PCT/IB2018/059931
§ 371 (c)(1),
(2) Date: Jun. 10, 2020

(87) PCT Pub. No.: WO2019/116254
PCT Pub. Date: Jun. 20, 2019

(65) Prior Publication Data

US 2020/0368093 A1 Nov. 26, 2020

(30) Foreign Application Priority Data

Dec. 12, 2017 (ZA) ..... 201708400

(51) Int. Cl.
*A61H 1/02* (2006.01)

(52) U.S. Cl.
CPC ..... *A61H 1/0218* (2013.01); *A61H 1/0255* (2013.01); *A61H 2201/0103* (2013.01); *A61H 2201/1642* (2013.01); *A61H 2201/5069* (2013.01); *A61H 2201/5097* (2013.01); *A61H 2203/0425* (2013.01); *A61H 2205/102* (2013.01)

(58) Field of Classification Search
USPC ..... 601/5
See application file for complete search history.

(56) References Cited

U.S. PATENT DOCUMENTS 5,033,457 A 7/1991 Bonutti
5,197,461 A 3/1993 Petajan et al.
5,529,573 A * 6/1996 Kelly ..... A61H 1/0259 601/33

(Continued)

FOREIGN PATENT DOCUMENTS

EP 0254522 A2 1/1988
WO WO-2008039519 A1 * 4/2008 ..... A61H 1/0218

OTHER PUBLICATIONS

Int'l. Search Report for PCT/IB2018/059931, dated May 7, 2019.

*Primary Examiner* — Valerie L Woodward
*Assistant Examiner* — Paige Kathleen Bugg
(74) *Attorney, Agent, or Firm* — Blue Filament Law PLLC

(57) ABSTRACT

A continuous passive motion apparatus is provided that includes a thigh support (40) connected by a hinge structure (38) to a base plate (36). The plate (36) is itself connected to a base (34). A bladder (54), which inflates to the form of a vertically elongate column, is cyclically inflated and deflated to lift the thigh support (40) in movements about a hinge (46) connecting it to an upper hinge plate (42) of the hinge structure (38). The hinge structure also includes a lower hinge plate (44). A foot support (72) is connected by a cord (68) to the thigh support (40).

11 Claims, 7 Drawing Sheets

(56) References Cited

U.S. PATENT DOCUMENTS

| | | | | |
|---|---|---|---|---|
| 2011/0118635 | A1* | 5/2011 | Yamamoto | A61H 1/0262 601/5 |
| 2017/0367644 | A1* | 12/2017 | Sharman | A61B 5/1121 |

* cited by examiner

CONTINUOUS PASSIVE MOTION APPARATUS

FIELD OF THE INVENTION

This invention relates to continuous passive motion apparatus.

BACKGROUND TO THE INVENTION

Movement of the knee joint is extremely important for the healing process following knee surgery or when a knee has been injured. The soft tissue of the knee heals better with motion. Restoring the range of movement in a knee post-surgery or post-injury is also important and motion is used as a therapeutic technique for this purpose.

Continuous passive motion (CPM) is a therapeutic technique that involves the knee being subjected to a specified range of motion by an appropriate device or machine. This device can used at any time throughout the day or night and moves the knee without the patient having to exert any force or energy.

Continuous passive motion not only helps facilitate the requisite return of range of motion but is also a therapeutic means to facilitate regrowth of cartilage and as a pain reliever.

U.S. Pat. No. 5,529,573 and European specification 0 254 522 disclose passive motion apparatus. The United States specification discloses apparatus which includes a hinged frame which is displaced between an extended condition and a collapsed condition by an array of bellows. The bellows act between a base plate and a flap the lower edge of which is connected by a hinge to the base plate. A thigh support is connected by another hinge to the upper edge of the flap.

The apparatus of the European specification includes two inflatable pillows. The first is of elongate form and supports the patient's leg from thigh to foot. The other is of triangular configuration and presses on the underside of that part of the first pillow that is directly below the knee. The pillows are inflated and deflated in sequence.

The present invention seeks to provide an improved continuous passive motion apparatus.

BRIEF DESCRIPTION OF THE INVENTION

According to the present invention there is provided continuous passive motion apparatus comprising a base, a support for the thigh of a patient, an inflatable bladder below the thigh support for lifting the thigh support as the bladder is inflated and lowering it as the bladder is deflated, and a connection between the base and the thigh support which permits the thigh support to change its angle with respect to the base as the bladder inflates and deflates and which also permits the support to perform rectilinear movements with respect to the base.

In one form said bladder is cylindrical in shape when inflated with the axis of the inflated bladder extending horizontally. Said connection can comprise loops of cord passing through openings in the thigh support and the base.

In another form of the apparatus said bladder is, when inflated, of cylindrical shape with the axis of the cylinder extending vertically. In this form said bladder preferably comprises, when inflated, first and second axially aligned cylindrical compartments with an air flow passageway between the lower end of the upper compartment and the upper end of the lower compartment.

Said connection can be in the form of a hinge structure which comprises a first hinge connecting said thigh support to a first hinge plate, a second hinge connecting the first hinge plate to a second hinge plate, and a third hinge connecting the second hinge plate to a base plate, said hinges permitting the first and second hinge plates to collapse on top of one another sandwiched between said thigh support and said base plate.

A possible modification is that the base plate is omitted and the third hinge connects the second hinge plate to said base.

There can be a further inflatable bladder in a space between said hinge structure and the first mentioned bladder, the further inflatable bladder, in use, forcing the part of the thigh support adjacent the connection upwardly as it inflates.

The apparatus can include a foot support connected by a cord to said thigh support at a position remote from said hinge structure so that the foot support is pulled towards said hinge structure as the first mentioned bladder inflates. When the foot support and cord are provided it is preferred that the cord pass around a guide, a first part of the cord between the foot support and the guide being generally horizontal and a second part of the cord extending upwardly from the guide to the thigh support.

In one form of the apparatus there is an additional bladder adjacent said second part of the cord, the additional bladder, as it inflates, bulging and pushing on said second part of the cord, the effective cord path between said guide and the connection of the cord to the thigh support being greater when the additional bladder is inflated than it is when the additional bladder is deflated.

For inflation and deflation purposes there can be an air pump driven by an electric motor and an electrically operated valve connecting the pump to the bladder or bladders for inflation purposes and for connecting the bladder or bladders to atmosphere for the purpose of deflating the bladder or bladders.

A microprocessor can be included for controlling operation of said pump and valve so as cyclically to inflate and deflate the bladder or bladders.

The apparatus can further include means for enabling a wireless connection to be made to a remote location whereby the settings of the microprocessor can be altered from said remote location.

One or more accelerometers can be provided for attachment to a patient's leg for feeding to the microprocessor information on the angle to which the knee has been flexed.

BRIEF DESCRIPTION OF THE DRAWINGS

For a better understanding of the present invention, and to show how the same may be carried into effect, reference will now be made, by way of example, to the accompanying drawings in which:—

DETAILED DESCRIPTION OF THE DRAWINGS

Figure 1:
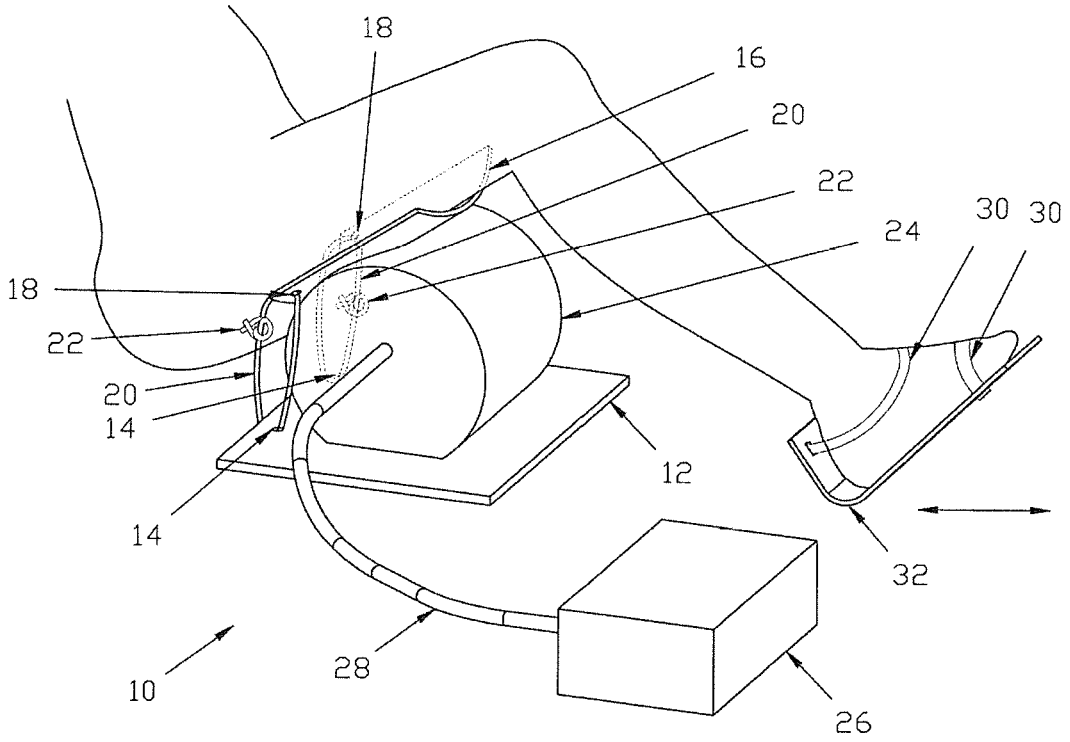
FIG. 1 is a diagrammatic representation of continuous passive motion apparatus in accordance with the present invention.
Figure 2:
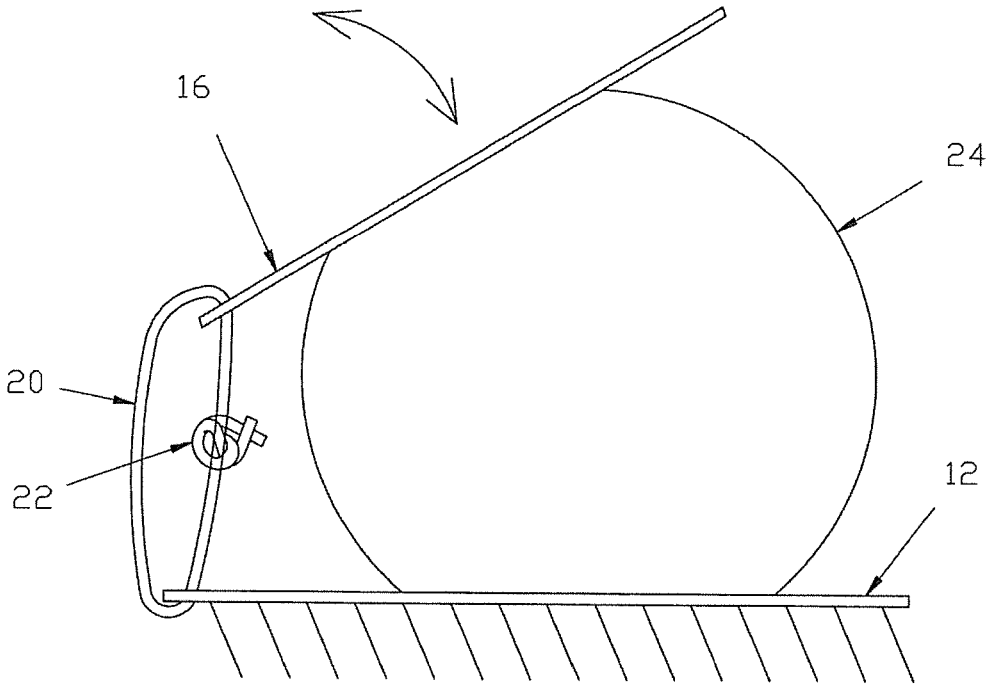
FIG. 2 is an end elevation of part of the apparatus of FIG. 1.
Figure 3:
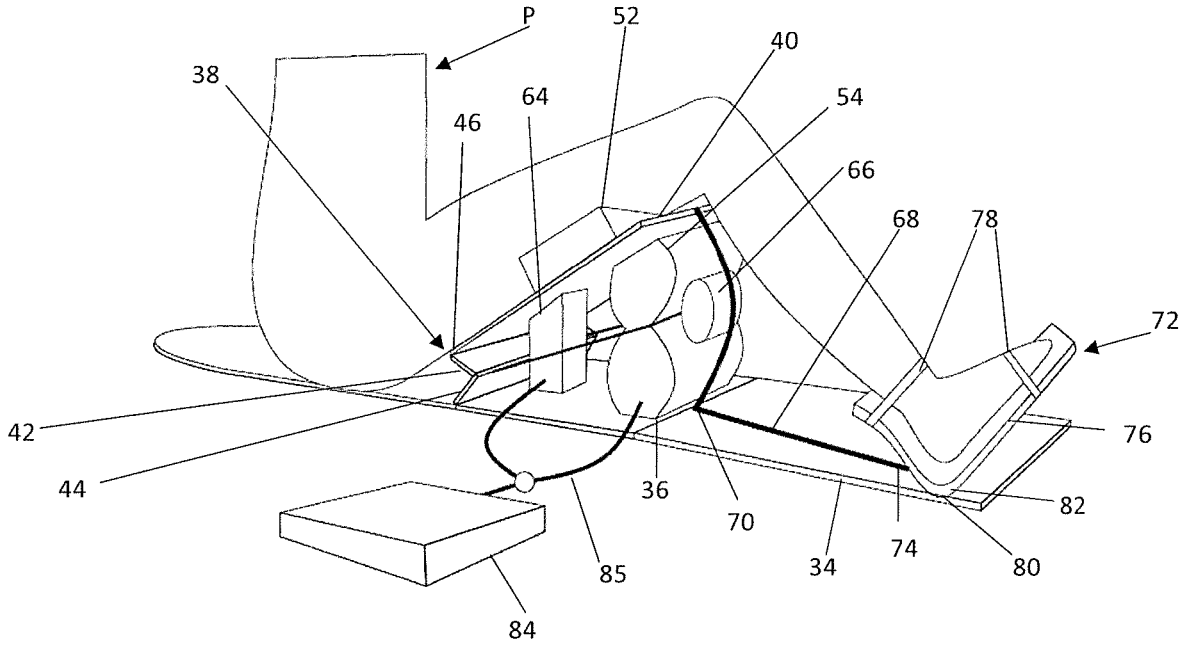
FIG. 3 is a diagrammatic representation of further form of continuous passive motion apparatus.
Figure 4:
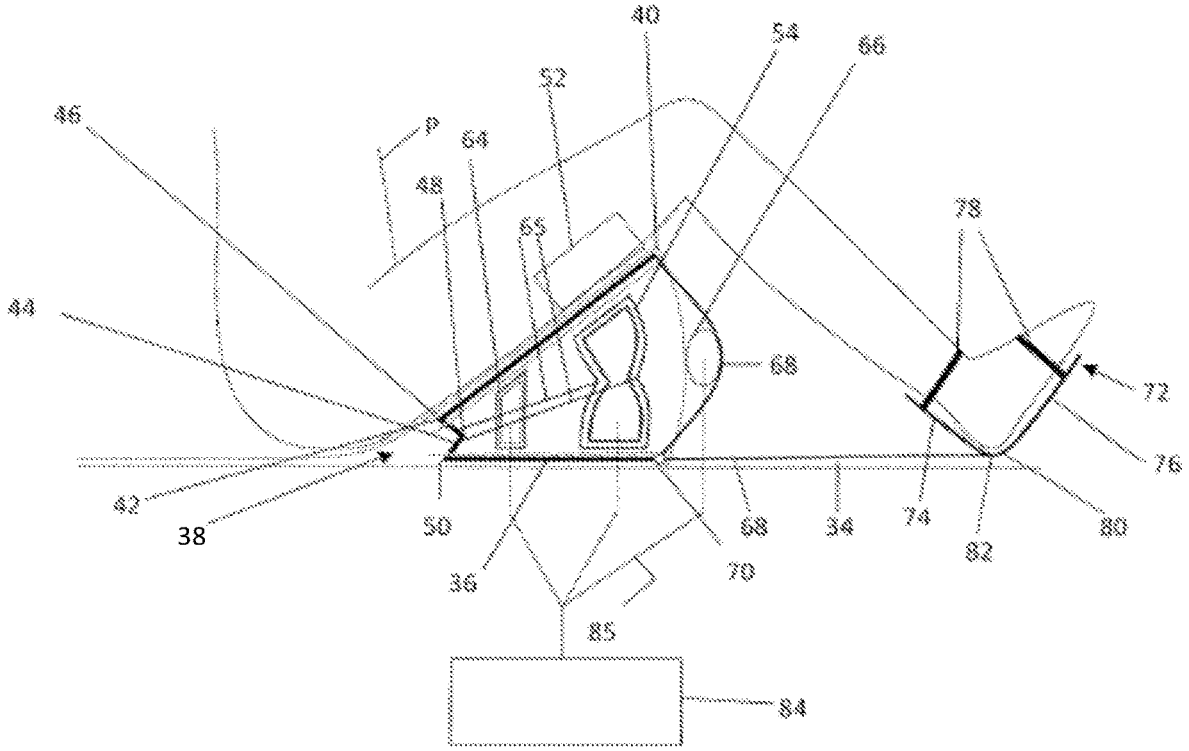
FIG. 4 is a diagrammatic vertical section through the apparatus of FIG. 3.
Figure 5:
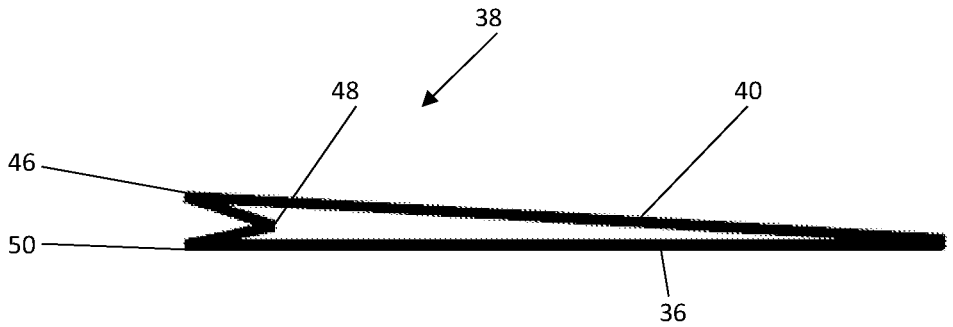
FIGS. 5 and 6 illustrate a hinge mechanism in two different operative positions.

The continuous passive motion apparatus 10 illustrated in FIGS. 1 and 2 comprises a base 12 which is of rectangular configuration. Along its rear edge the base has a pair of holes 14 which are spaced apart across the base 12.

The apparatus further includes an elongate thigh support 16 which is, in transverse section, U-shaped. This enables it to fit snugly around the underside of the patient's thigh, as shown, when the patient is sitting adjacent the rear edge of the base 12 with his or her leg extending across the base 12.

The rear transverse edge of the thigh support 16 has two holes 18 in it.

The base 12 and the support 16 are connected by two cords 20. Each cord 20 passes through one of the holes 14 and through one of the holes 18 and is tied into the form of a loop by means of a knot 22.

There is a cylindrical inflatable bladder 24 between the base 12 and the thigh support 16. The bladder is inflated and deflated cyclically by a unit 26 which comprises a pump driven by an electric motor (neither of which is shown) and a solenoid operated exhaust valve (not shown) connected to the bladder 24 by a pipe 28. A pump and valve control system is incorporated into the unit 26.

In use, the patient sits adjacent the base 12 with his or her thigh resting on the support 16. The patient's foot is connected by straps 30 to a foot support 32 which has a configuration such that it slides easily on the floor. If the floor itself has a slippery surface on which a socked foot will slide, the support 32 can be omitted.

If the patient's leg is extended, and the bladder 24 is deflated, then the patient's leg is effectively flat on the floor. The pump is then activated and the exhaust valve closed so that the bladder 24 is inflated. This exerts an upward force on the patient's thigh and lifts the patient's leg to the illustrated position. The patient's buttocks remain on the base. The bladder 24, and the hinges between the base 12 and the support 16 which are constituted by the cords 20, are at this time as shown in FIG. 2. The pump is then deactivated and the exhaust valve opened so that the bladder deflates and the patient's leg straightens from the bent position illustrated back to a position in which it again lies flat as indicated by the double headed arrow in FIG. 2.

Connecting the thigh support 16 to the base 12 as illustrated, and using a cylindrical bladder, provides balanced, stable, comfortable lifting of the leg.

Turning now to FIGS. 3 to 6, the continuous passive motion apparatus illustrated in these figures comprises a base 34 to which a base plate 36 is connected as described below. A hinge structure 38 comprising two narrow hinge plates 40 and 42 connects the base plate 36 to a thigh support 44. There are hinges at 46, 48 and 50. This enables the hinge structure to move between the two end positions illustrated in FIGS. 5 and 6. The thigh support 44 can rotate about the hinge 46 as shown by the arrow A. It also free to perform a rectilinear movement by pushing or pulling the strip 42 so that it performs a rotational movement about the hinge 48.

A trough shaped element 52 can be provided on the top surface of the support 40 into which the thigh fits.

Figure 7:
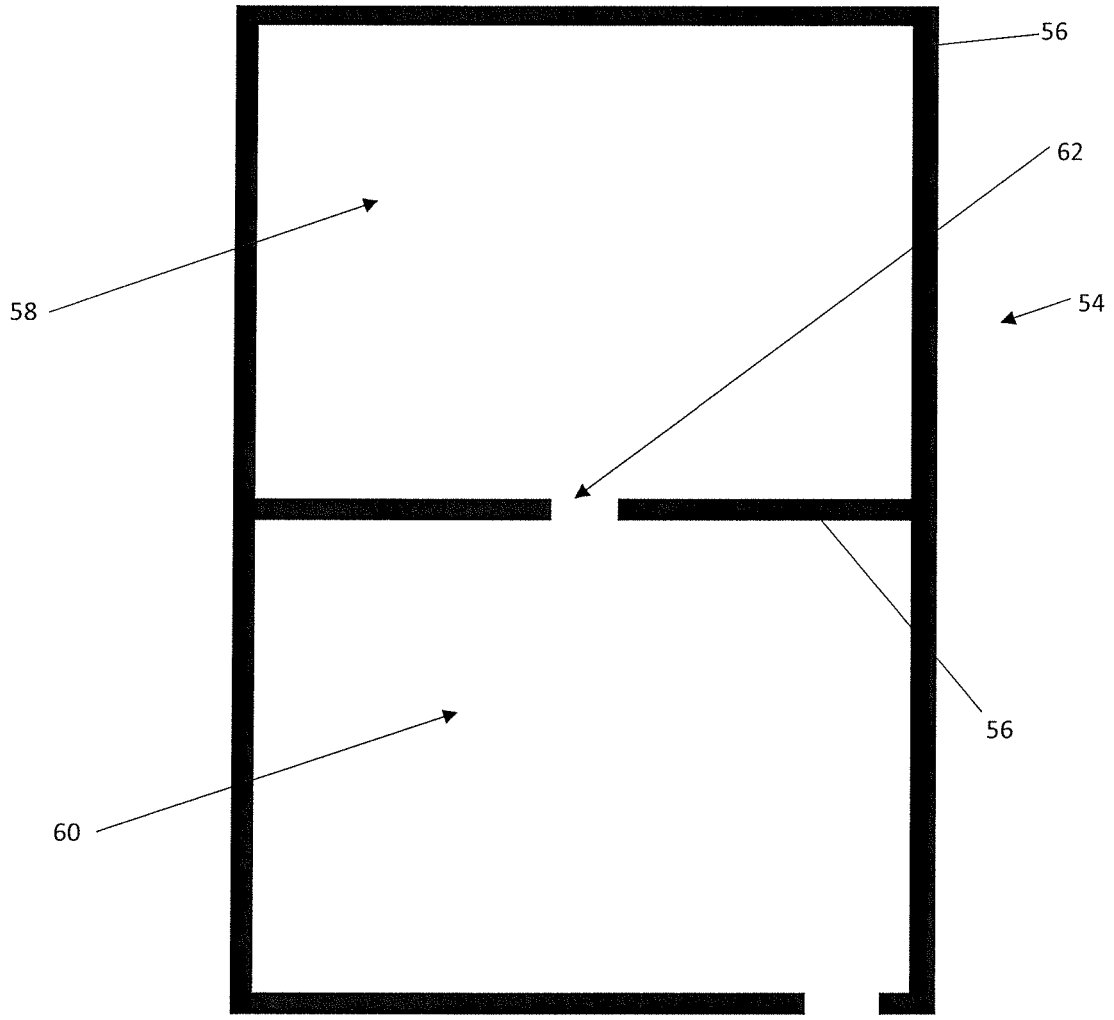
FIG. 7 is a plan view of an inflatable bladder.

A bag (not shown) of flexible fabric is provided. The bag is secured to the base 34 and includes a pocket into which the plate 36 slides thereby to connect it to the base 34. Within the bag there is an inflatable bladder 54. The bladder 54, as shown in FIG. 7, comprises two superimposed layers of sheet synthetic plastics material which, when viewed in a lay flat condition as shown in FIG. 7, are of elongate rectangular form. The layers are secured together along weld lines 56 thereby to provide two compartments 58 and 60. The compartments are connected through a gap 62 in the transverse centre weld line.

The bladder 54 is attached to the inside of the bag by, for example, pieces of the hook and loop material which is generally referred to as Velcro. The purpose of this is to keep the inflated bladder upright with the compartments 58 and 60 stacked one above the other. There are tethers 65 which assist in ensuring that the bladder 54 is confined to an upright-position.

An additional bladder within the bag is shown at 64. This provides, as it inflates, an upward force on the thigh support 40 immediately adjacent the hinge structure 38.

Another bladder within the bag is shown at 66. This is secured to, and on inflation bears on, that upright wall of the bag which is remote from the hinge structure 38. The bladder 66 is shaped so that it has a convex front face when inflated. During inflation the wall of the bag is pushed outwardly to adopt the configuration of the bladder 66.

A cord 68 has one end secured to the free edge of the support 40, that is, to the edge remote from the hinge structure 38. The cord 68 extends down from the support 40 to a guide 70 which can be in the form of a pulley which is mounted on the free edge of the base plate 36. It then extends forward to a foot rest 72. The foot rest 72 has a back plate 74, a sole plate 76 and straps 78 for securing the foot rest to the foot of the person using the apparatus.

The foot rest's back and sole plates merge by way of a curving section 80 so that the foot rest can slide smoothly back and forwards during use of the apparatus.

A transverse hinge 82 is provided in the section 80 so that the angle between the sole and back plates can be varied to suit the foot configuration of the user.

The controls for the apparatus, an air pump and a flow control valve are contained in a control box 84 which will be described in detail below. Pipes 85 connect the valve to the bladders.

In use of the apparatus, the person whose leg is to be exercised sits on the base 34. The weight of the patient ensures that the apparatus is unable to move in any direction.

The patient's leg is stretched out horizontally and lies on the thigh support 40 which is itself at this time in a substantially horizontal position and juxtaposed to the base plate 36. The bladders 54, 64 and 66 are all deflated. The foot rest 72 is strapped on to the patient's foot and is connected to the support 40 by the cord 68.

The pump is then activated and air flows into all the bladders. As the bladders 54 and 64 inflate the thigh support 40 is tilted upwardly about the hinge 46. The hinge plates 42 and 44 open up to the position illustrated in FIGS. 3, 4 and 6. By virtue of its connection to the inside of the bag and the use of tethers 65 the bladder 54 is constrained to inflate with the compartments 58 and 60 one above the other.

As the bladder 66 inflates, the front wall of the bag of forced outwardly thereby increasing the effective distance between the anchorage point of the cord 68 on the support 40 and the guide 70. The cord 68 pulls the foot rest 72 towards the base plate 34 as the patient's thigh is pushed upwardly by the bladders 54 and 64.

Figure 6:
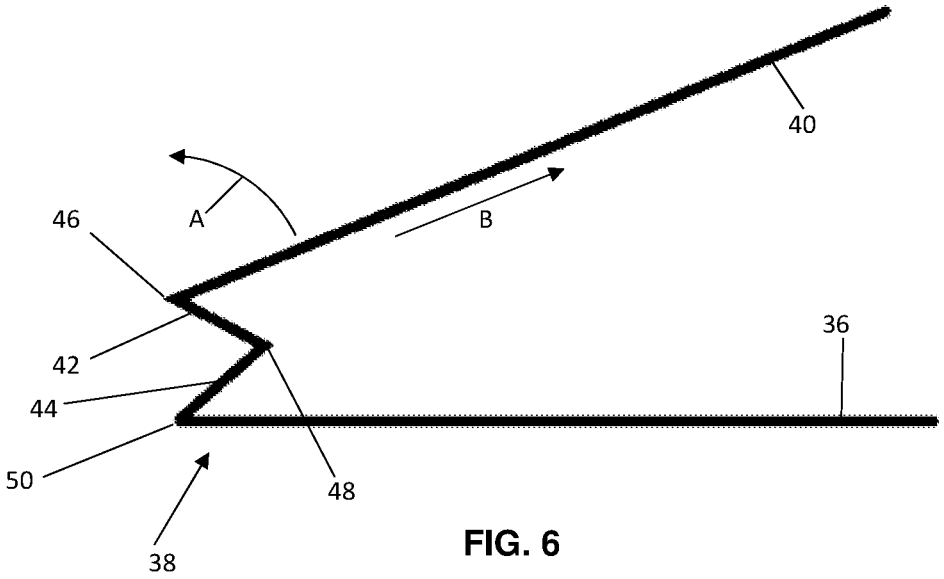

When the support 40 reaches a predetermined angle, the pump is switched off and the valve is opened to allow controlled airflow from the bladders. The support 40 returns slowly to its horizontal position, the hinge plates 42, 44 collapsing into a stack on top of one another as shown in FIG. 6. As the knee straightens the patient's lower leg pushes the footrest 72 away from the base plate 36, sliding on the curved section 80.

Figure 8:
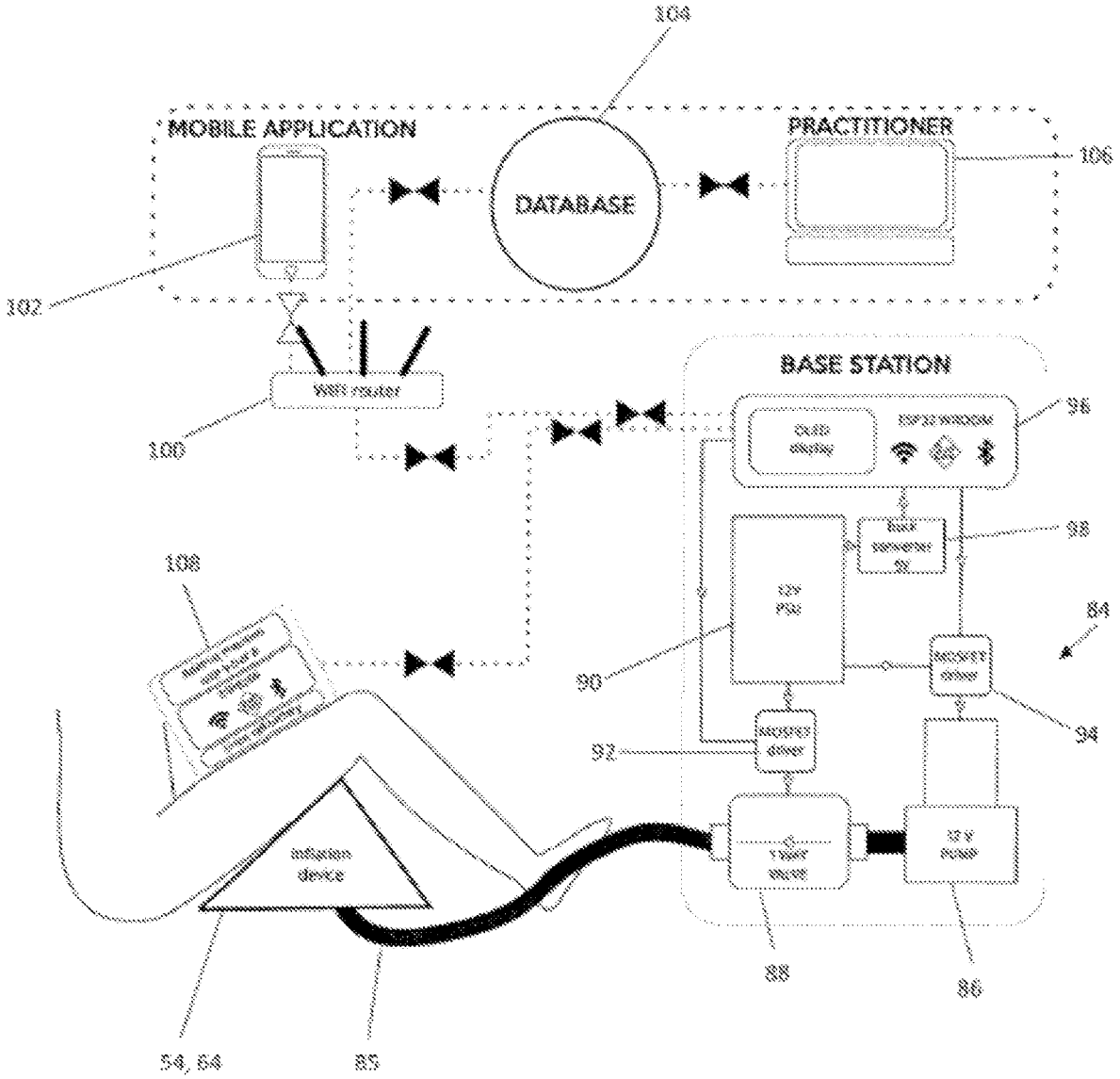
FIG. 8 is a diagrammatic representation of the air supply and communication components of the apparatus.

Within the control box 84 there is, in addition to the pump 86 and valve 88 as shown in FIG. 8, a 12 volt power supply 90 and Mosfet drivers 92 and 94 through which power is supplied to the pump 86 and an electrically operated solenoid valve 88. A microprocessor is shown at 96 and there is a buck converter 98 for supplying power to the microprocessor. An ESP 32 WROOM is a suitable microprocessor for controlling the functions of the passive apparatus.

The microprocessor includes Bluetooth or other wireless communication ability and can be connected to a wifi router 100 and/or to a mobile device 102.

As the patient is usually under the care of a medical practitioner, the microprocessor can communicate directly with the database 104 at the practitioner's rooms where the patient's records are stored. The medical practitioner can view the records on the screen 106 and can remotely set the program on the microprocessor so that the patient is advanced from one exercise regimen to another.

The angle to which the knee has been flexed constitutes important information that the medical practitioner overseeing the treatment requires. To obtain this information, it is possible to secure an accelerometer to the patient's thigh or to the lower leg below the knee. A zero reading is taken whilst the leg is horizontal. As the angle of the accelerometer with respect to horizontal changes as the knee flexes, real-time signals can be fed to the medical practitioner. The final reading indicates how far the knee has been flexed. In FIG. 8 reference numeral 108 designates a diagrammatically shown accelerometer, a transmitter for sending signals to the router 100 or to the mobile device 102 and a battery for powering the accelerometer and the transmitter.

More accurate readings can be obtained by securing two accelerometers to the patient's leg, one above the knee and one below. Readings taken from these are subtracted one from the other to obtain an accurate indication of the degree to which the knee has been flexed.

The invention claimed is:

1. A continuous passive motion apparatus comprising:

a base, a thigh support configured for supporting a thigh of a patient, an inflatable first bladder below the thigh support for lifting the thigh support as the first bladder is inflated and lowering the thigh support as the first bladder is deflated, and a connection between the base and the thigh support which permits the thigh support to change its angle with respect to the base as the first bladder inflates and deflates, and which also permits the thigh support to perform rectilinear movements with respect to the base;

wherein said connection is formed as a hinge structure which comprises a first hinge connecting said thigh support to a first hinge plate, a second hinge connecting the first hinge plate to a second hinge plate, and a third hinge connecting the second hinge plate to a base plate, said first hinge, said second hinge, and said third hinge permitting the first hinge plate and the second hinge plate to collapse on top of one another sandwiched between said thigh support and said base plate;

and further comprising a foot support connected by a cord to said thigh support at a position remote from said hinge structure so that the foot support is pulled towards said hinge structure as the first bladder inflates.

2. The apparatus as claimed in claim 1, wherein said first bladder is cylindrical in shape when inflated with an axis of the inflated first bladder extending horizontally.

3. The apparatus as claimed in claim 1, wherein said first bladder is, when inflated, of cylindrical shape with an axis of the cylinder extending vertically.

4. The apparatus as claimed in claim 3, wherein said first bladder comprise, when inflated, upper and lower axially aligned cylindrical compartments with an air flow passageway between a lower end of the upper compartment and an upper end of the lower compartment.

5. The apparatus as claimed in claim 1, further comprising a second inflatable bladder in a space between said hinge structure and the first bladder, the second inflatable bladder, in use, forcing the part of the thigh support adjacent the connection upwardly as it inflates.

6. The apparatus as claimed in claim 1, wherein the cord passes around a guide, a first part of the cord between the foot support and the guide being generally horizontal and a second part of the cord extending upwardly from the guide to the thigh support.

7. The apparatus as claimed in claim 6, further comprising a third bladder adjacent said second part of the cord, the additional bladder, as it inflates, bulging and pushing on said second part of the cord, the effective cord path between said guide and the connection of the cord to the thigh support being greater when the additional bladder is inflated than it is when the additional bladder is deflated.

8. The apparatus as claimed in claim 1, further comprising an air pump driven by an electric motor and an electrically operated valve connecting the air pump to at least the first bladder for inflation purposes and for connecting at least the first bladder to atmosphere for the purpose of deflating at least the first bladder.

9. The apparatus as claimed in claim 8, further comprising a microprocessor for controlling operation of said air pump and valve so as cyclically to inflate and deflate at least the first bladder.

10. The apparatus as claimed in claim 9, further comprising means for enabling a wireless connection to be made to a remote location wherein settings of the microprocessor can be altered from said remote location.

11. The apparatus as claimed in claim 9, further comprising one or more accelerometers for attachment to a patient's leg for feeding to the microprocessor information on the angle to which a knee of the patient has been flexed.

* * * * *